US006409556B1

(12) United States Patent
Vance

(10) Patent No.: US 6,409,556 B1
(45) Date of Patent: Jun. 25, 2002

(54) VARIABLE HEIGHT OUTBOARD MOTOR MOUNT APPARATUS

(76) Inventor: David Edward Vance, 1260 Ardmore Hwy., Taft, TN (US) 38488

( * ) Notice: Subject to any disclaimer, the term of this patent is extended or adjusted under 35 U.S.C. 154(b) by 0 days.

(21) Appl. No.: 09/776,972

(22) Filed: Feb. 5, 2001

(51) Int. Cl.[7] ..... B63H 20/08
(52) U.S. Cl. ..... 440/61; 248/640; 248/641
(58) Field of Search ..... 440/61; 248/640, 248/641

(56) References Cited

U.S. PATENT DOCUMENTS 4,232,627 A * 11/1980 Glenn et al. ..... 248/641
4,482,330 A * 11/1984 Cook ..... 248/640
5,484,311 A * 1/1996 Detwiler et al. ..... 248/641

* cited by examiner

*Primary Examiner*—Sherman Basinger
(74) *Attorney, Agent, or Firm*—Joseph H. Beumer

(57) ABSTRACT

A motor mount for connecting an outboard motor to the transom of a boat includes mechanisms for raising and lowering the height of the motor with respect to the transom. The mount has an upper bracket and a lower bracket, each having upper and lower rectangular horizontal plates, all of which are aligned vertically. The horizontal plates of each bracket are connected to L-shaped vertical plates. The two brackets are interconnected and overlapped with the top plate of the lower bracket being located above the lower plate of the upper bracket. A pair of hydraulic cylinders operate between plates of the lower bracket, and piston rods propelled by the cylinders move the upper bracket up and down. Vertically extending rods are used to prevent twisting, and bearing capability is provided in cylinder assemblies.

9 Claims, 5 Drawing Sheets

VARIABLE HEIGHT OUTBOARD MOTOR MOUNT APPARATUS

FIELD OF THE INVENTION

This invention relates to outboard motor propulsion systems for boats and more particularly to motor mounts for such systems.

BACKGROUND OF THE INVENTION

In many instances it is desirable to provide for varying the height of outboard motors mounted on transoms of boats. Outboard motors typically have a cavitation plate for prevention of cavitation or slippage of the motor propeller due to passage of air as well as water through the propeller, which results in decreased efficiency of the motor. The optimum height of the motor for control of cavitation depends on various factors, in particular the speed of the motor and the load to which it is subjected. At lower speeds a lower position of the cavitation plate is more effective, while at higher speeds and particularly for racing applications a higher position is better. An ideal solution for obtaining maximum efficiency at both high and low speeds and under other variable conditions is to provide a motor mount with capability for varying the motor height as needed for operating at both high and low speeds.

Variable-height motor mounts using slidably connected brackets are disclosed in certain prior patents. U.S. Pat. No. 4,482,330, issued to Cook, employs a pair of brackets, one connected to a transom and the other connected to a motor, with the brackets being subject to relative vertical movement by action of a hydraulic cylinder. This apparatus employs bolt-and-slot assemblies wherein side edge plates of both brackets are overlapped and are held in position by bolts extending through aligned vertical plates of the bracket. Difficulty is presented in maintaining the bolts tight enough to avoid vibration, but loose enough to allow sliding. Another apparatus using a pair of brackets separately connected to a transom and an outboard motor and provided with means for vertically moving the motor bracket is disclosed in U.S. Pat. No. 5,484,311, issued to Detwiler, et al. The brackets in this device are rectangular frames with the transom bracket located entirely inside the motor bracket. Each of the brackets has a top plate and a bottom plate connected by side plates. A single cylinder is located between horizontal plates of the transom bracket, the cylinder propelling a piston rod secured to the top plate of the motor bracket. Alignment guides are provided in the form of rods extending over the entire height of the motor bracket, passing through hollow tubular members disposed between upper and lower plates of the transom bracket. Bearings are located inside the tubular members to guide the rods in a straight, vertical path. It is desired to provide a motor mount which effectively performs required vertical movement functions and which enables enhanced dimensional stability, particularly with regard to resistance to twisting forces produced by large motors.

SUMMARY OF THE INVENTION

The present invention is directed to an outboard motor mount for supporting an outboard motor on the transom of a boat in a manner such that the height of the motor in relation to the height of the transom may be readily varied, even when the motor is in operation. The mount comprises a first, forward bracket attachable to a transom and a second, rearward bracket attachable to a motor and adapted to be moved upward and downward in relation to the first bracket.

Unique structure and interconnections between the two brackets are employed to obtain an improved motor mount.

Each of the two brackets has a pair of rectangular, horizontally disposed plates, one at the top of the bracket and the other at the bottom. Top and bottom plates of each bracket are fixedly connected to L-shaped vertically extending plates, preferably L-shaped corner plates located at forward corners of the first transom bracket and at rearward corners of the second bracket. The two brackets overlap one another in that the bottom horizontal plate of the top, second bracket is placed below the upper horizontal plate of the first bracket, and the upper horizontal plate of the first bracket is placed above the bottom horizontal plate of the second bracket, between the upper and lower plates of the second bracket. All four of the horizontal plates may have the same width and length with the four corners of each of the plates being in vertical alignment with one another.

The motor mount of this invention also comprises fluid actuator means in the form of a pair of hydraulic cylinders having their lower ends connected to the bottom plate of the first bracket and their upper ends connected to upper plate of the first bracket, with the cylinder passing through an aperture in the bottom horizontal plate of the second bracket and adapted for sliding vertical movement of the apertured plate along the length of the cylinders. The cylinders each contains a hydraulically actuated piston connected to a rod at the lower end of the rod, with the upper end of the rod connected to the upper horizontal plate of the second bracket. This enables the second bracket to be moved up and down upon introduction of pressurized fluid into an appropriate locations in the cylinder.

The motor mount of this invention also comprises vertically extending rods at selected locations to counteract twisting effects resulting from operation of the motor. The anti-twisting rods may extend from the bottom plate to the top plate of each bracket, with a preferred arrangement being two such rods in each bracket placed at opposite locations between the cylinders and adjacent plate edges.

The cylinders are provided in assemblies which include material and structures selected to provide a bearing effect and to maintain vertical alignment of the plates and brackets.

It is therefor an object of this invention to provide a variable height motor mount for connecting an outboard motor to a boat transom wherein a range of vertical movements may be obtained.

Another object is to provide such a motor mount having increased strength and resistance to twisting effects.

Other objects and advantages of the invention will be apparent from the following detailed description.

DESCRIPTION OF THE PREFERRED EMBODIMENT

Figure 1:
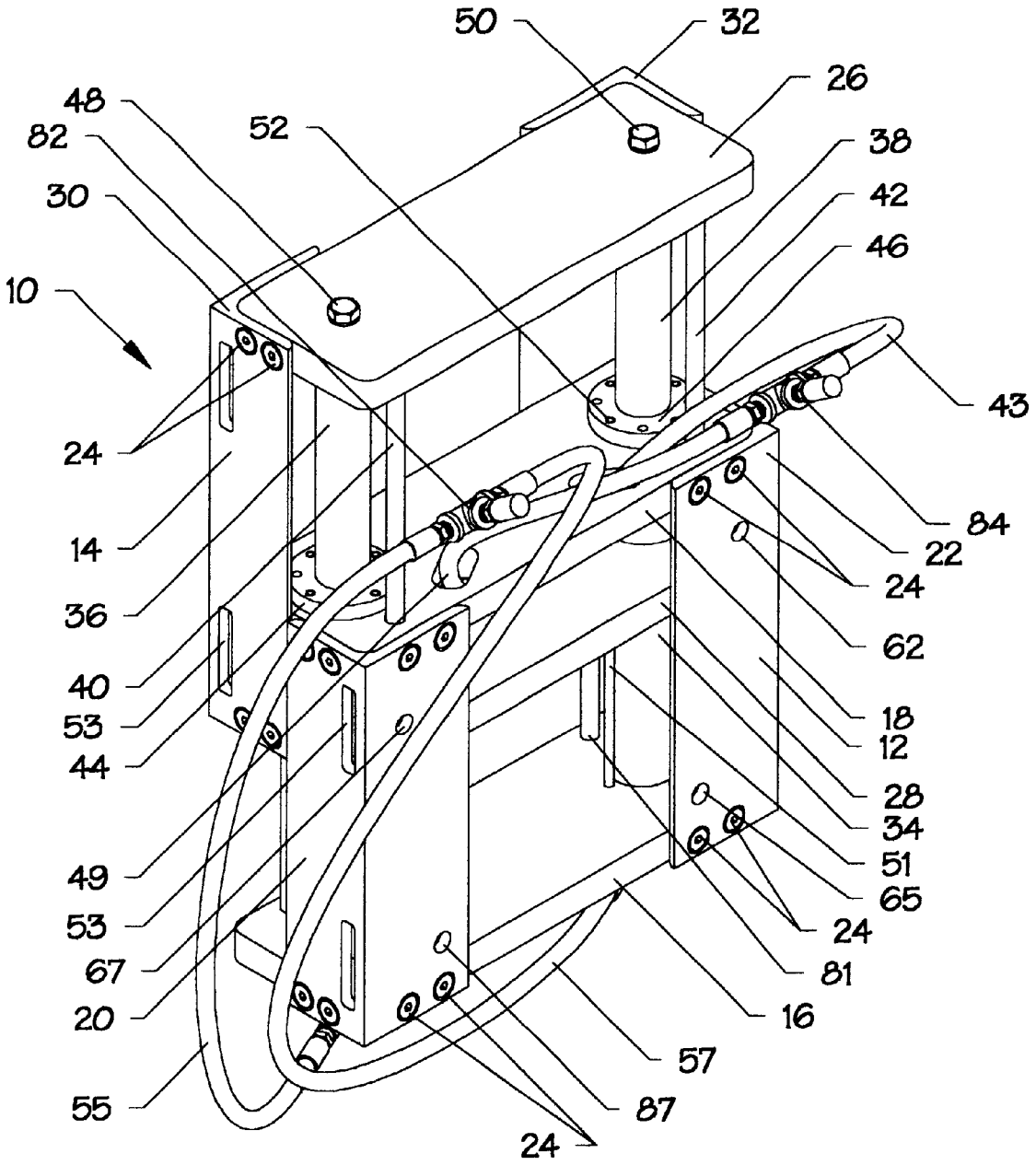
FIG. 1 is an isometric view taken from the forward side and above showing a motor mount embodying the invention.

Referring to FIG. 1 of the drawings there is shown an outboard motor mount 10 embodying the invention. The mount has a lower bracket 12 connectable to the transom of a boat and an upper bracket 14 connectable to an outboard motor. Bracket 12 when attached to a transom remains in a fixed position, while bracket 14 moves vertically to raise or lower the motor to which it is connected. Each of the brackets has top and bottom rectangular horizontal plates and a pair of L-shaped vertical edge plates connecting the horizontal plates. Bracket 12 includes a horizontal bottom plate 16 and a top plate 18 parallel to the bottom plate. The top and bottom plates of bracket 12 are connected to one another by L-shaped vertical plates 20 and 22 located at forward corners of the horizontal plates and secured by screws 24. Bracket 14, has a similar structure, including a top horizontal plate 26 and a bottom plate 28 connected to one another by L-shaped vertical plates 30, 32 located at rearward corners of the horizontal plates and secured by screws 24. It is noted that the two brackets are overlapped with one another in that top horizontal plate 18 of lower bracket 12 is located above bottom horizontal plate 28 of upper bracket 14. The vertical L-shaped corner plates each are placed to extend over a portion of the end width of the horizontal plate to which it is attached. This allows vertical edges of adjacent plates exemplified by plates 20 and 30 to be moved pastone another without interference. widths of the adjacent plates may be such as to put their adjacent edges in close proximity or spaced apart, leaving a gap.

Figure 2:
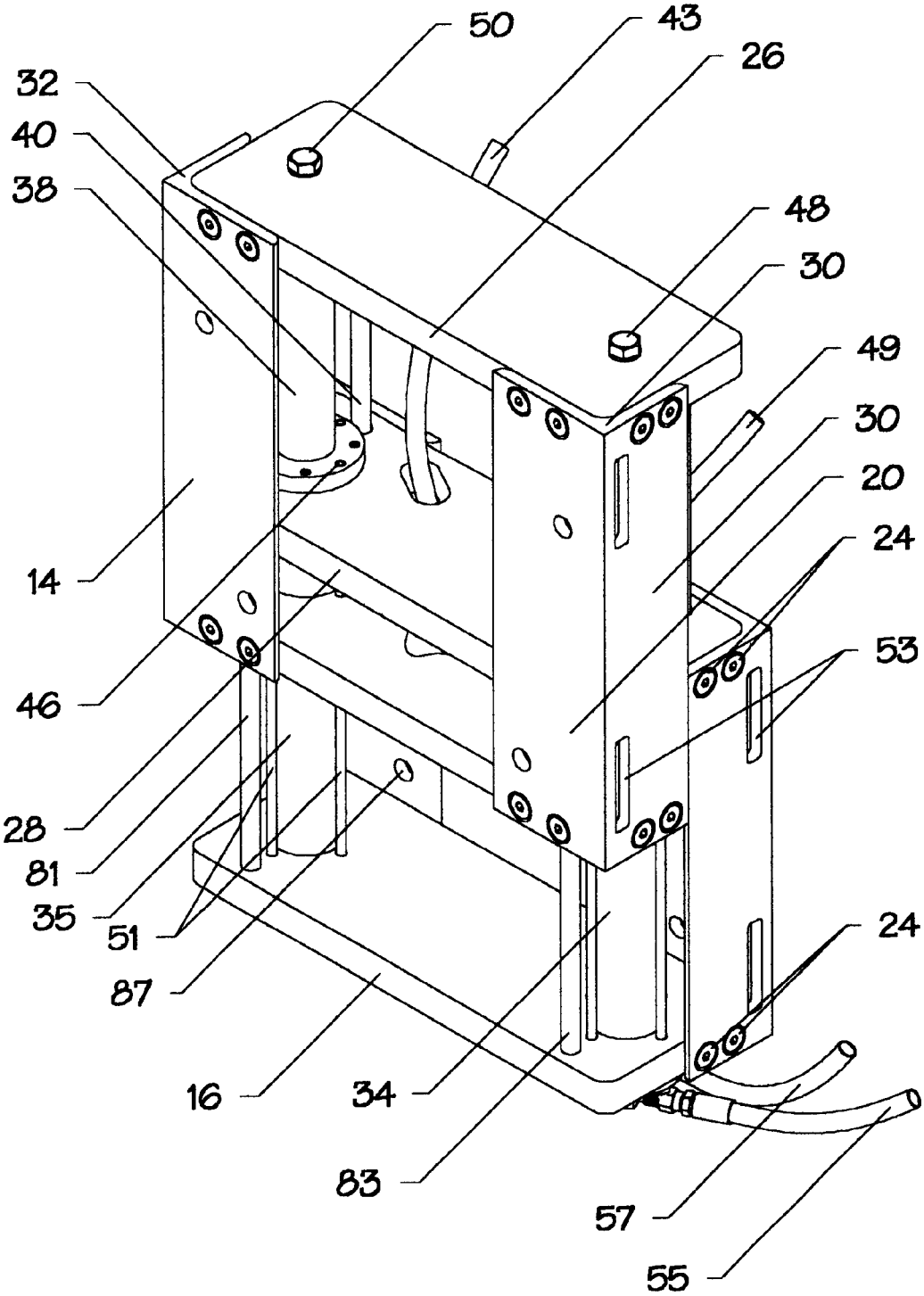
FIG. 2 is an isometric view of the apparatus of FIG. 1 taken from the rearward side thereof.
Figure 3:
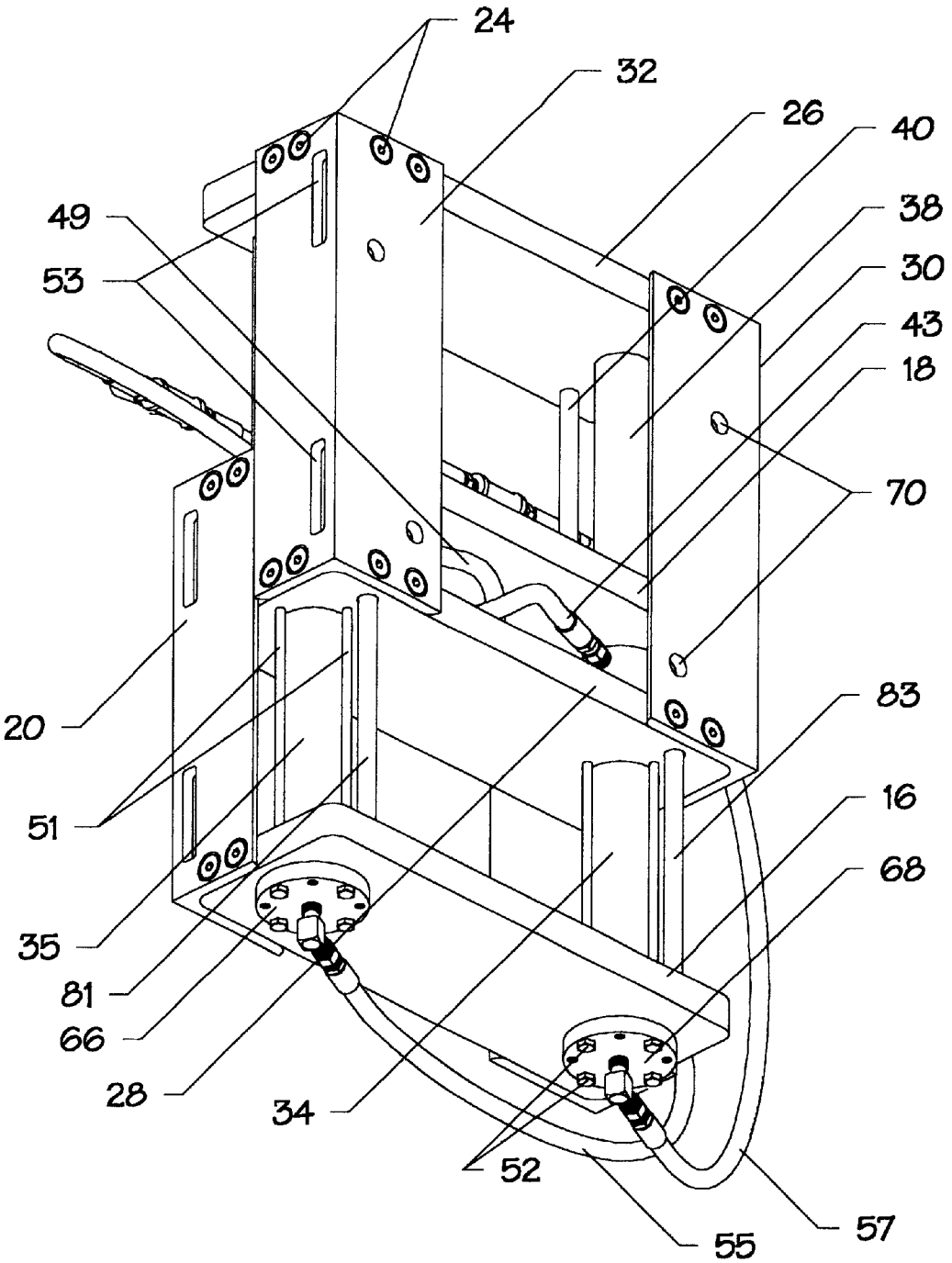
FIG. 3 is an isometric view taken from the rearward side and slightly below the apparatus.
Figure 5:
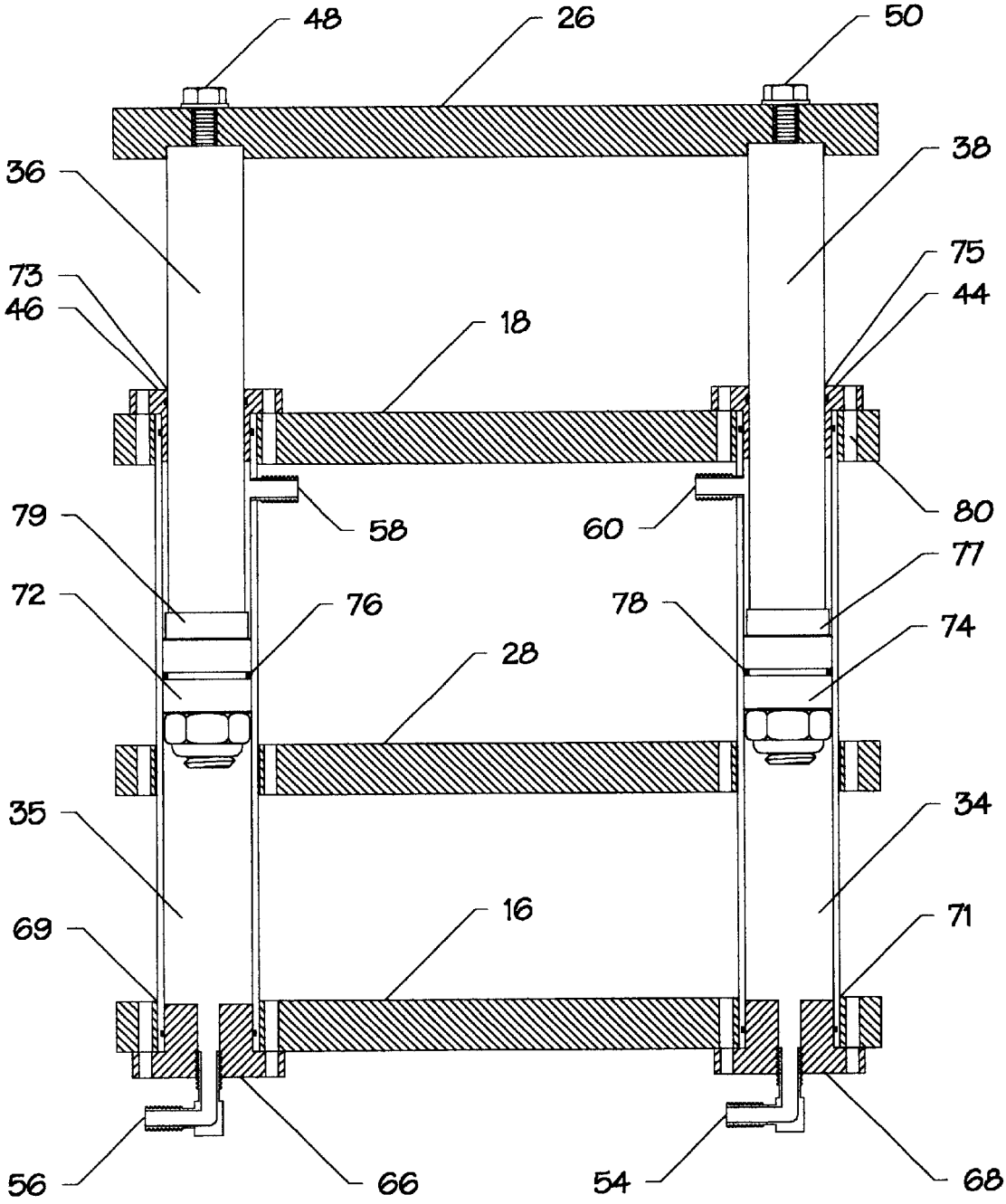
FIG. 5 is a sectional view taken through the cylinders as shown in FIG. 1.

A pair of hydraulic cylinders 34, 35 (FIG. 2) are carried by lower bracket 12. Lower ends of the cylinders as shown in FIGS. 3 and 5 are held in place by end caps 66, 68 which have a circumferential shoulder through which elongated, threaded bolts 51 extend, the bolts secured by nuts 52. End caps 66, 68 are located in apertures 69, 71 provided in bottom plate 16. Upper ends of the cylinders are connected to plate 18 in a manner similar to lower end connections. End caps 44, 46 have a circumferential shoulder through which the top ends of bolts 51 extend. These end caps also have large axial apertures 73, 75 through which extend rods 36, 38 propelled by the pistons. Top ends of the piston rods are connected to upper plate 26 of bracket 14 by bolts 48, 50.

Cylinders 34, 35 are combined with other components to provide assemblies capable of carrying out movements of the top bracket 14 along with the additional function of keeping the brackets in vertical alignment. As shown in FIG. 5, cylinders 34, 35 contain pistons 72, 74 which are movable up or down, depending on the direction of flow of introduced pressurized fluid. O-rings 76, 78 are disposed in circumferential grooves of the piston gland to form seals so as to prevent fluid from by-passing the pistons. Rods 36, 38 are connected at their lower ends to pistons 72, 74, with uppermost portions 71, 79 of the piston glands having a slightly reduced diameter and taper to facilitate downward fluid flow between the inner walls of the cylinders and the pistons.

Figure 4:
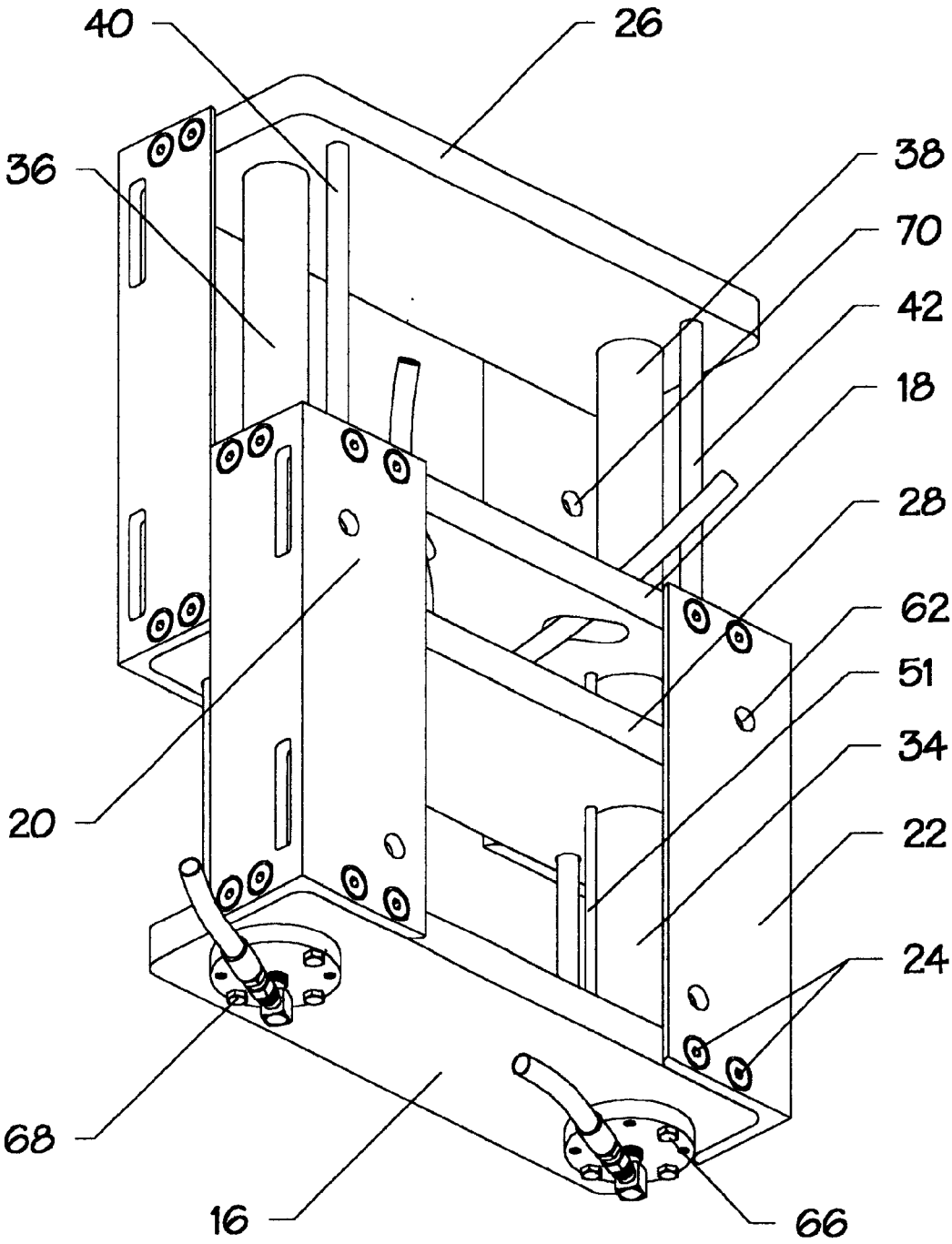
FIG. 4 is an isometric view taken from the forward side and slightly below.

The motor mount of this invention also comprises a plurality of rods 40, 42, and 81, 83 having their upper ends embedded in upper plates of the brackets and their lower ends embodied in lower plates thereof. The guide rods pass through the plates located between upper and lower plates of the respective brackets without making sliding contact with plate surfaces adjacent to the apertures, a small gap being provided for this purpose. The rods serve to prevent twisting between brackets owing to torque effects produced by the motor. As shown in FIG. 4 rods 40, 42 of upper bracket 14 are placed between the cylinders and a lengthwise edge of the upper plate and rods 81, 83 of the lower bracket 12 are located between the cylinders and the plate side in a position opposite to rods 40, 42. This placement further contributes to avoidance of twisting.

Bolt holes are provided in vertical plates of the brackets to enable connection to the transom and motor. As shown in FIG. 1 holes 67, 87 are located in plate 20 and holes 62, 65 are placed in plate 22 of the lower bracket, and similar holes 70 are provided in plates 30, 32 as shown in FIG. 3. The vertical plates also have vertical slots 53 as shown in Fig. to enable access of a suitable tool in the process of tightening bolts in making connections to the transom and motor.

In operation, upward movement of the upper bracket is obtained by introducing pressurized fluid from a source (not shown) to cylinders 34, 35 through lines 55, 57 and inlet fittings 54, 56, the fluid exerting force against pistons 72, 74, with propulsive pressure being maintained by O-ring seals 76, 78. Downward movement is obtained by introduction of pressurized fluid through lines 43, 49 and inlet fittings 58, 60. The fluid passes along a gap between the cylinder and piston walls, exerting force against the O-ring seals. To provide simultaneous movement of each of the pistons 72, 74, the inlet lines are fed through the fittings 82, 84 connected to a common fluid source (not shown). Timing and control of piston movements may be implemented by previously known circuits and techniques.

An important aspect of providing effective motor mounts embodying the invention is the selection of suitable materials of construction and, in some cases, their process history to obtain necessary strength and resistance to corrosion in a spraying water environment, along with a resistance to becoming misaligned or twisted. Other desired properties include surface characteristics in the cylinder assemblies for providing a bearing effect and preventing galling of moving parts in contact with one another.

Horizontal plates of both brackets are preferably made of 6061 T6 aluminum alloy and may have a thickness of one inch. Anti-twist rods are preferably comprised of 304 stainless steel. The cylinders are preferably made of stainless steel, and interior are honed to facilitate sliding movement. End caps and piston glands which come into sliding contact with other components may be made of ductile iron, which provides a bearing effect and serves to prevent galling. Piston rods are preferably make of No. 17-4 stainless steel heat treated to Rockwell hardness 34-38.

While the invention is described above in terms of a specific embodiment, it is not to be understood as limited to this embodiment but is limited only as indicated by the appended claims. Various minor modifications may be made by one skilled in the art without departing from the scope of the invention.

What is claimed is:

1. An apparatus for mounting an outboard motor on a transom of a boat comprising a first bracket connectable to said transom and having a horizontal upper plate, a spaced-apart horizontal lower plate in alignment with said upper plate and a plurality of first vertical plates connected to said upper plate and said lower plate;

a second bracket connectable to said motor and having a horizontal upper plate, a spaced-apart horizontal lower plate in alignment with said upper plate of said second bracket and a plurality of second vertical plates connected to said upper plate and lower plate of said second bracket;

said first bracket and said second bracket being vertically aligned and slidably connected to one another whereby said second bracket may be raised and lowered with respect to said first bracket;

said upper horizontal plate of said second bracket being disposed above said upper horizontal plate of said first bracket and said lower horizontal plate of said second bracket being disposed between said upper and lower horizontal plates of said first bracket defining a vertically overlapped area therebetween;

a plurality of rods connected to said first and second brackets for prevention of twisting; and a means for effecting vertical movement of said brackets with respect to one another.

2. The apparatus as defined in claim 1 wherein said horizontal plates are rectangular.

3. The apparatus as defined in claim 2 wherein said means for effecting vertical movement comprises a pair of hydraulic cylinders having a lower-end connected to said lower horizontal plate of said first bracket and an upper end connected to an upper end of said first bracket, a piston slidably disposed in each said cylinder for vertical movement therein, each said piston connected to a rod and having a lower end and an upper end, the lower end of said rod connected to said piston and the upper end thereof connected to said upper horizontal plate of said second bracket.

4. The apparatus as defined in claim 3 including two pairs of twist-preventing rods, rods of a first said pair having an upper end connected to said upper horizontal plate of said first bracket and a lower end connected to said lower horizontal horizontal plate of said first bracket and rods of a second said pair having an upper end connected to said upper horizontal plate of said second bracket and a lower end connected to said lower horizontal plate of said second bracket, said rods extending through apertures in horizontal plates located between said upper and lower plates of a said brackets.

5. The apparatus as defined in claim 4 wherein said cylinders are disposed along a center line of said horizontal plates and a first pair of said twist preventing rods are carried in each said bracket both rods of one pair being located directly between a said cylinder and an adjacent side of a horizontal plate in the first bracket and the twist preventing rods of a second pair are located in the said second bracket between a cylinder and a horizontal edge of a said horizontal plate on a side opposite to the first pair of said rods.

6. Apparatus as defined in claim 3 including a pair of inlet fittings, one of each communicating with the interior of a said cylinder at a location near the top thereof, a pair of inlet fittings disposed in communication with said bottom ends of said cylinders and fluid lines connecting said inlet fitting to a common source of pressurized fluid.

7. The apparatus as defined in claim 2 wherein said vertical plates connecting said horizontal plates comprise L-shaped corner plates each having a first leaf adapted for connection along the length of a said plate adjacent to a corner thereof and a second leaf adapted for connection along the width of a said plate adjacent to a corner thereof.

8. The apparatus as defined in claim 7 wherein said horizontal plates have a uniform width and said L-shaped vertical corner plates are placed in facing relation at opposing corners and adjacent leaves of said L-shaped plates each occupying a portion of the end area of the bracket to which the L-shaped plates are attached so that facing edges of vertical leaves at end locations of overlapped portions of said brackets may be moved past one another without interference.

9. The apparatus as defined in claim 8 wherein adjacent end leaves of L-shaped plates are deployed in a common plane.

* * * * *